United States Patent [19]

Goldner

[11] 4,316,402

[45] Feb. 23, 1982

[54] ADJUSTABLE END PIN FOR THE VIOLONCELLO AND THE STRING BASS

[76] Inventor: Richard Goldner, 3717 Toad Lake Rd., Bellingham, Wash. 98225

[21] Appl. No.: 225,845

[22] Filed: Jan. 16, 1981

[51] Int. Cl.[3] ..... G10G 5/00

[52] U.S. Cl. ..... 84/280; 84/327

[58] Field of Search ..... 84/280 C, 327, 453

[56] References Cited

U.S. PATENT DOCUMENTS

| | | | |
|---|---|---|---|
| 838,649 | 12/1906 | Rockwell | 84/280 C |
| 2,502,229 | 3/1950 | Miller | 84/327 X |
| 3,160,050 | 12/1964 | Klein | 84/327 |

OTHER PUBLICATIONS

L. A. Elkington, 1963 Catalog, p. 28.

*Primary Examiner*—Lawrence R. Franklin
*Attorney, Agent, or Firm*—Reed, Smith, Shaw & McClay

[57] ABSTRACT

An improved end pin for the violoncello and the string bass which comprises a receiving member having an outer nonslip support surface with an arcuate portion adapted to contact floor. The receiving member includes a cavity for receiving the existing end pin of a violoncello or string bass, in the case of retrofit applications, or a rod projecting out for replacement of existing pins. Means are provided for securely locking an existing end pin into the cavity of the receiving member. A yoke member is pivotally mounted to the receiving member for arcuate movement about the support surface and includes an opening therethrough for adjustably receiving a pin means. An adjustable pin means having a first pointed end extending from the yoke mounting to contact a surface for supporting said violoncello or string bass and a second end extending from the yoke to the outer support surface of the receiving member for adjustably securing said yoke relative to the receiving member. The end pin includes between said ends a means for adjustable mounting within the yoke.

8 Claims, 6 Drawing Figures

ADJUSTABLE END PIN FOR THE VIOLONCELLO AND THE STRING BASS

FIELD OF THE INVENTION

The invention relates to an improved end pin for replacement or retrofit use on musical instruments requiring an end pin for support on a floor or other surface, and, in particular, an improved end pin for violoncello and string bass.

BACKGROUND OF THE INVENTION

The violoncello and string bass are instruments that require an end pin for support on a floor or other support surface. Generally, these end pins can be retracted into the body of the instrument when not in use and can be adjusted outwardly to suit the build and preference of the player. The angle between the end pin and the floor normally varies from player to player. For example, some cellists use an end pin which is permanently angularly bent to permit a relatively acute angle between the instrument and the floor. However, such angularity is fixed rather than adjustable and does not allow the end pin to fully retract into the instrument and at least portions of them have to be carried separately.

The more acute the angle between the instrument and the floor the greater likelihood there is that the instrument will slip during play. On many surfaces such as concrete, marble and the like and most wooden floors such as used on stages, rostrums and podiums it is difficult to find reliable anchor points for the end pin. Various devices have been used to secure or anchor these instruments independently from the quality or nature of the floor surface. Devices such as a sponge rubber with a metal cup or pieces of wood attached to the leg of a chair are being used. Rubber tips are generally used to avoid injury and to protect the point of the pin. Their surface contact is not very effective to prevent slippage, except perhaps on a carpet-type surface. Moreover, with the assertion of any pressure on the instrument, the pin will penetrate the protective rubber tip.

For the most part, the devices available are generally unsatisfactory in that they must be separately carried and are easily forgotton, require set up time or do not eliminate instrument slippage. Devices such as metal cups do not provide secure support when the instrument is in an acute angle to the floor. Accordingly, it is an object of the present invention to overcome the disadvantages of the prior art devices and to provide an end pin which can be adjusted to virtually any position with the floor while at the same time greatly reducing or eliminating the possibility of the instrument slipping. It is a further object of the present invention to provide an end pin which may be used to replace the retractable end pin of the instrument or may be fitted onto an existing end pin by the player. It is also an object of the present invention to provide an end pin which is adaptable to any type of floor surface to prevent both damage to the floor and the pin itself.

SUMMARY OF THE INVENTION

Generally, the end pin of the present invention comprises a receiving member preferably molded or machined from a material such as Delrin $^{R}$ or equivalent polymer, hard rubber or other suitable material. The receiving member includes an outer support surface having an arcuate portion.

In applications where the adjustable end pin of the present invention is to be mounted to an existing end pin of a violoncello or string bass, the receiving member includes a cavity therein which is configured to receive the existing end pin of the instrument. A locking means positioned adjacent to or integral with the cavity is provided to lock the existing end pin to the receiving member. Preferably, such locking means comprises two pairs of set screws positioned in the receiving member or a collar mounted to the receiving member adjacent to cavity.

In the case where the end pin of the present invention is to be used as a replacement for the existing end pin of the violoncello or string bass, a rod is positioned within the cavity for mounting to the instrument. Alternatively, the receiving member may include an integrally molded or machined cylindrical extension adapted to mount to the instrument.

Pivotally mounted to the receiving member is a yoke which is adapted for arcuate movement about the support surface thereof. The yoke includes an opening preferably threaded therethrough for receiving a pin means having first and second ends with a threaded portion therebetween. The pin means is threadably mounted within the opening and includes the first end pointed to contact the floor or other surface supporting said instrument and a second end extending from the yoke to the outer support surface for adjustably securing said yoke relative to the receiving member. Preferably, the pin means includes means for rotatably adjusting the pin within the opening to position the second end relative of the support surface.

The outer support surface is preferably provided with a textured, nonslip surface to support the instrument when the yoke and pin are rotated out of use. The textured or nonslip surface may be provided by etching the support surface or by means of an overlay of rubber or plastic material attached thereto.

The end pin of the present invention is mounted to the existing end pin of the instrument by sliding the receiving member over the existing end pin so that such end pin is positioned within the cavity and secured by the locking means. By rotating the yoke relative to the receiving member any angle between 0° and 180° can be achieved between the floor and the axis of the instrument. Once that desired angle is located, the pin means is rotatably adjusted so that its second end securely contacts the support surface of the receiving member to prevent relative movement therebetween. In the event that the floor surface is not suitable for contact with the pointed end of the pin means the yoke can be rotated so as to render it inoperative and the outer support surface of the receiving member can be used to support the instrument. Other advantages of the present invention will become apparent from a perusal of the following detailed description of the presently preferred embodiments of the invention taken in connection with the accompanying drawings.

PRESENTLY PREFERRED EMBODIMENTS

Figure 1:
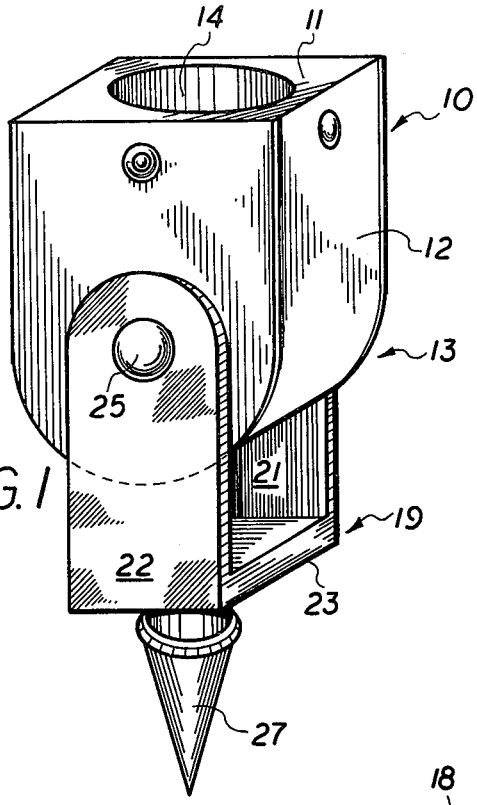
FIG. 1 is a perspective view of one embodiment of the present invention.
Figure 2:
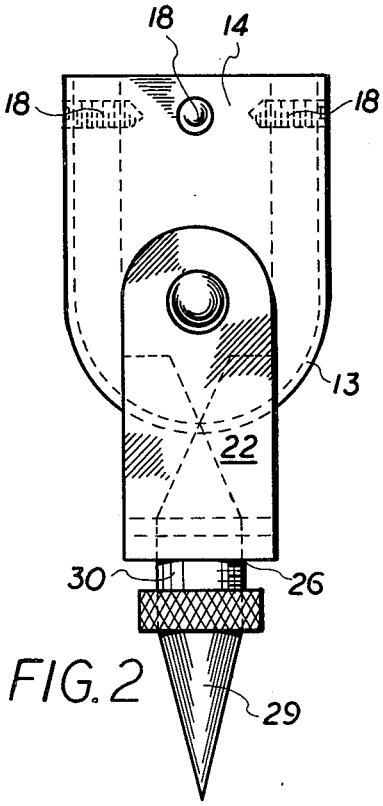
FIG. 2 is a side elevation of the improved end pin shown in FIG. 1.
Figure 3:
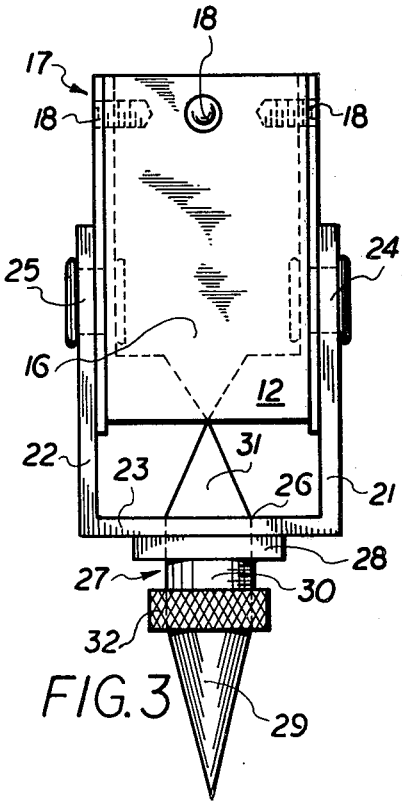
FIG. 3 is a front elevation of the improved end pin shown in FIG. 1.

Referring to FIGS. 1 through 3, end pin 10 of the present invention is shown. End pin 10 includes a receiving member 11 having a nonslip outer support surface 12. Nonslip support surface 12 includes arcuate portion 13 adapted for contact with a floor or other instrument support. Receiving member 11 includes a cavity 14 preferably sized and configured to receive an existing end pin of a violoncello or string bass. As shown, cavity 14 includes conical base 16 which accommodates the point of an existing end pin. Locking means 17 comprising set screws 18 are provided to securely lock the existing end pin of the instrument within cavity 14. While four set screws 18 are shown, it is clear that less than four may be used as well as other types of securing means such as thumb screws or the like.

Yoke 19 comprises first and second mounting arms 21 and 22, respectively and base 23 positioned extending between said arms. Yoke 19 is pivotally mounted to the ends of receiving member 11 by pivot means 24 and 25, respectively. Pivot means 24 and 25 may comprise rivot pins extending through associated openings in arms 21 and 22, respectively, and endwalls of receiving member 11 as shown in FIG. 3. Alternatively, mushroom-type pins or straight pins may be integrally molded with yoke 19 and force fit through the associated openings in receiving member 11. Yoke 19 is spaced from support surface 12 only far enough to permit rotation thereof away from arcuate portion 13 in addition to any nonslip surface added to the face thereof. An opening 26 is preferably provided in the center of base 23 of yoke 19 to receive a pin means 27. Opening 26 is preferably threaded to adjustable mounting pin 27 or alternatively, a threaded nut 28 may be mounted to base 23 adjacent to opening 26 to threadably receive pin 27.

Pin 27 includes first and second ends 29 and 31, respectively, and a threaded portion 30 between said ends. First end 29 is pointed and extends from below the base of yoke 23 to contact a floor or other surface used to support the instrument. Second end 31 may be pointed or slightly rounded and extends from above base 23 of yoke 19 to support surface 12 of receiving member 11. Second end 31 is adapted to contact support surface 12 by rotation of pin 27 in opening 26 or nut 28.

To facilitate rotating pin means 27 a knurled or grooved rotating means 32 is provided adjacent to threaded portion 30. While pin 27 preferably is threaded at portion 30 for adjustably mounting within opening 26, other means of securing pin 27 to yoke 19 may be used. Hence, by rotating means 32, pin 27 can be variably positioned along its axis with respect to yoke 19 so that second end 31 contacts surface 12 to lock yoke 19 against relative movement with respect to receiving member 11. According, any angle between the axis of cavity 14 (the axis of the instrument) and the floor can be achieved by rotating yoke 19 with respect to receiving member 11 and locking them against relative movement. Additionally, yoke 19 can be rotated approximately 120° so as to expose arcuate portion 13 as the support surface for the instrument.

Figure 4:
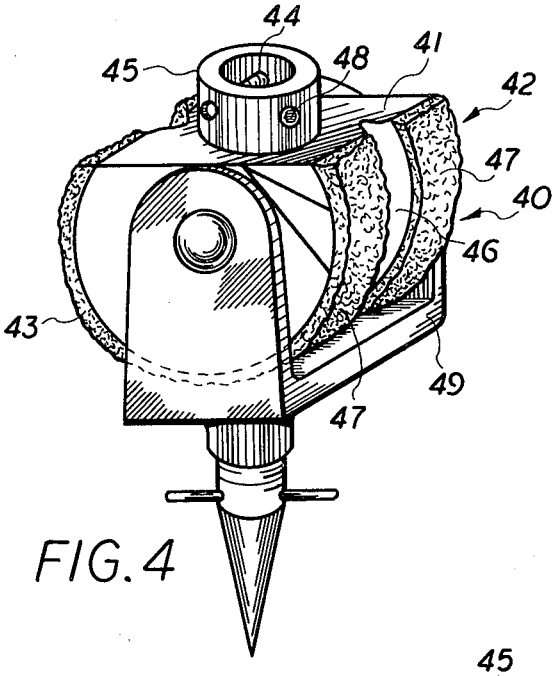
FIG. 4 is a perspective view of another embodiment of the present invention.
Figure 5:
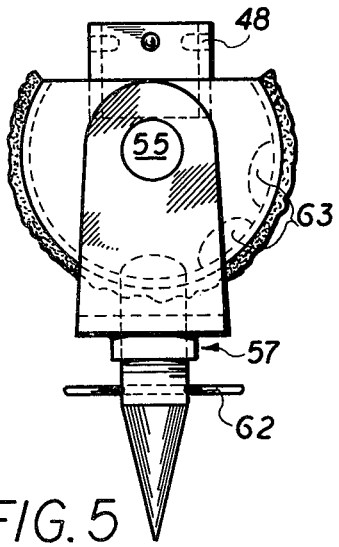
FIG. 5 is a side elevation of the improved end pin shown in FIG. 4.
Figure 6:
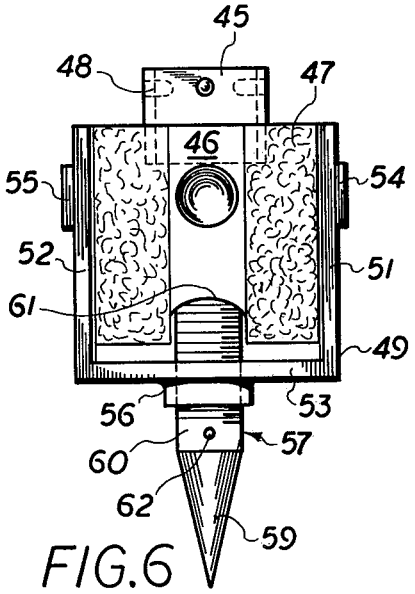
FIG. 6 is a front elevation of the end pin shown in FIG. 4.

Referring to FIGS. 4 through 6, another embodiment of the present invention is shown. In this embodiment, end pin 40 includes a receiving means 41 having a support surface 42 which comprises a generally arcuate portion 43. A cavity 44 is formed in receiving member 41. A metal collar 45 is positioned with cavity 44 and includes locking means 48 which comprises two pairs of opposing set screws or three equi-spaced screws. As shown, outer support surface 42 includes an annular groove 46 and nonslip rubber or polymeric overlays 47 on either side of groove 46. These overlays may be permanently affixed to the support surface or fastened thereover to facilitate removing for replacement.

A yoke means 49 comprising first and second arms 51 and 52, respectively, joined by base 53 is pivotally mounted to the ends of receiving member 41 by pivot means 54 and 55, respectively. Base 53 includes an annular depending flange 56 having a threaded opening for threadable engagement of pin means 57. Pin means 57 includes first and second ends 59 and 61, respectively, and threaded portion 60 between said ends. Pin means 57 also includes gripping means 62 comprising a rod mounted through said pin to facilitate rotation of pin 57. As shown, groove 46 includes a number of detents 63 for receiving second end 61 of pin 57.

Detents 63 are useful for providing pre-selected angular adjustments between yoke 49 and receiving member 41 and may be positioned about the circumference of groove 47 or just a portion thereof as shown in FIG. 5. To facilitate making such detents, it is possible to place a corrugated or perforated strip of metal or plastic under the nonslip Material. End 61 will compress the nonslip material into the corrugation or perforation to provide accurate registry.

While presently preferred embodiments of the invention have been shown and described in particularly, the invention may be otherwise embodied within the scope of the appended claims.

What is claimed is:

1. An adjustable end pin for the violoncello and the string bass comprising of:

a. a receiving member having a nonslip outer support surface at least a portion of which is arcuate, said receiving member including a cavity having a locking means for receiving and locking therein the existing end pin of a violoncello or string bass;

b. a yoke pivotally mounted to said receiving member and spaced away from said support surface for rotation thereabout; and c. a pin means having first and second ends adjustably mounted to said yoke for relative movement with respect to said yoke, said first end having a point and extending from said yoke and said second end projected from said yoke and adapted to contact said support surface by adjusting said pin to restrict relative movement of the yoke.

2. An adjustable end pin as set forth in claim 1 wherein said support surface of the receiving member is substantially arcuate.

3. An adjustable end pin as set forth in claim 1 and 2 wherein said receiving member includes a rod permanently mounted therein by said locking means.

4. An adjustable end pin as set forth in claim 1 wherein said outer support surface includes a rubber or plastic nonslip overlay.

5. An adjustable end pin as set forth in claim 1 and 4 wherein said outer support surface includes a plurality of detents and said second end of said pin means is adapted to engage said detents for locking the relative movement between said yoke and receiving member.

6. An adjustable end pin as set forth in claim 4 wherein said support surface includes a corrugated strip or strip having perforations interposed between said surface and overlay.

7. An adjustable end pin as set forth in claim 1 wherein said cavity includes a collar positioned therein, said collar including said locking means integrally contained therewith.

8. An adjustable end pin as set forth in claim 1 wherein said pin means is threadably mounted to said yoke for relative movement therein.

* * * * *